US005078799A

United States Patent [19]

Matter et al.

[11] Patent Number: 5,078,799

[45] Date of Patent: Jan. 7, 1992

[54] PROCESS FOR RECOVERING CRUDE OIL OR REFINERY PRODUCTS FROM SLUDGY, THICKENED OR SEDIMENTED PRODUCTS

[75] Inventors: Rolf Matter, London, United Kingdom; Bernard Paringaux, Marseille, France

[73] Assignee: Fiprosa Holding, Luxembourg, Luxembourg

[21] Appl. No.: 142,834

[22] Filed: Jan. 6, 1988

Related U.S. Application Data

[63] Continuation-in-part of Ser. No. 800,604, filed as PCT/EP85/00090, Mar. 8, 1985, abandoned.

[30] Foreign Application Priority Data

Mar. 13, 1984 [CH] Switzerland ..... 1246/84
Dec. 31, 1984 [CH] Switzerland ..... 6209/84

[51] Int. Cl.[5] ..... B08B 3/02; B08B 9/093; C23G 5/024

[52] U.S. Cl. ..... 134/22.18; 208/13; 134/24; 134/40; 134/88; 134/167 R; 137/13; 137/15; 239/251

[58] Field of Search ..... 208/13; 134/5, 21, 22.12, 134/22.18, 24, 40, 88, 22.1, 22.11, 22.14, 22.19, 25.1, 25.4, 10, 14, 39, 172, 175, 200, 201, 168 R, 169 R; 137/13, 14, 15, 334, 339, 563; 239/251, 261, 263, 280

[56] References Cited

U.S. PATENT DOCUMENTS

| | | | |
|---|---|---|---|
| 2,574,958 | 11/1951 | Carr | 259/110 |
| 3,125,295 | 3/1964 | Moss et al. | 239/102 |
| 3,125,297 | 3/1964 | Copeland et al. | 239/261 |
| 3,436,263 | 4/1969 | Strenkert et al. | 134/22 |
| 3,809,317 | 5/1974 | Bender | 239/251 |
| 3,874,399 | 4/1975 | Ishihara | 134/24 |
| 4,426,233 | 1/1984 | Manabe et al. | 134/24 |
| 4,592,786 | 6/1986 | Williams et al. | 134/22.18 |

FOREIGN PATENT DOCUMENTS

| | | | |
|---|---|---|---|
| 467506 | 10/1928 | Fed. Rep. of Germany . | |
| 462043 | 1/1914 | France . | |
| 2164137 | 7/1973 | France . | |
| 2211546 | 7/1974 | France . | |
| 30491 | 3/1981 | Japan | 208/13 |
| 7409461 | 1/1975 | Netherlands . | |
| 339158 | 8/1959 | Switzerland . | |
| 1361557 | 7/1974 | United Kingdom | 134/22.18 |

*Primary Examiner*—Paul E. Konopka
*Attorney, Agent, or Firm*—Frishauf, Holtz, Goodman & Woodman

[57] ABSTRACT

To render residues such as thickened sludge and sedimented crude oil or refinery products which collect at the bottom of a tank into pumpable flowable condition, crude oil is taken from an upward region of the tank, pumped upwardly to a suction pump (609)-pressure pump (605) unit (610) located, for example, on top of a floating roof of the tank, the pressurized crude oil taken from the top portion of the tank being reintroduced through a preferably rotating liquefaction lance (13) to a region in the vicinity of the sedimented sludge. The pressure is converted into hydrodynamic energy. Preferably, a plurality of such lances are used, arranged with respect to each other to form eddies or vorteces, to establish flow patterns within the tank, thereby liquefying the sludge or residues and rendering them into pumpable flowable condition for removal from the tank. Preferably, the suction and pressure pump together with the motor include a portable unit which can be placed on a floating roof, the respective inlet and lance portions being introduced through openings in the roof, for example coaxial with leg sleeves (601) customarily attached to such roofs and already present therein.

12 Claims, 7 Drawing Sheets

FIG. 11
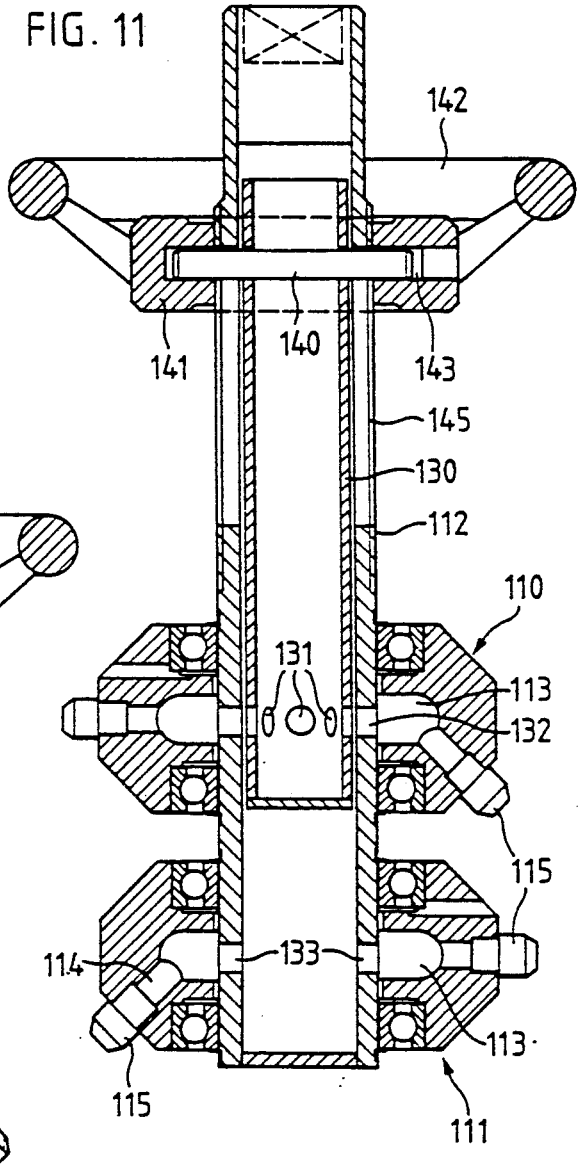
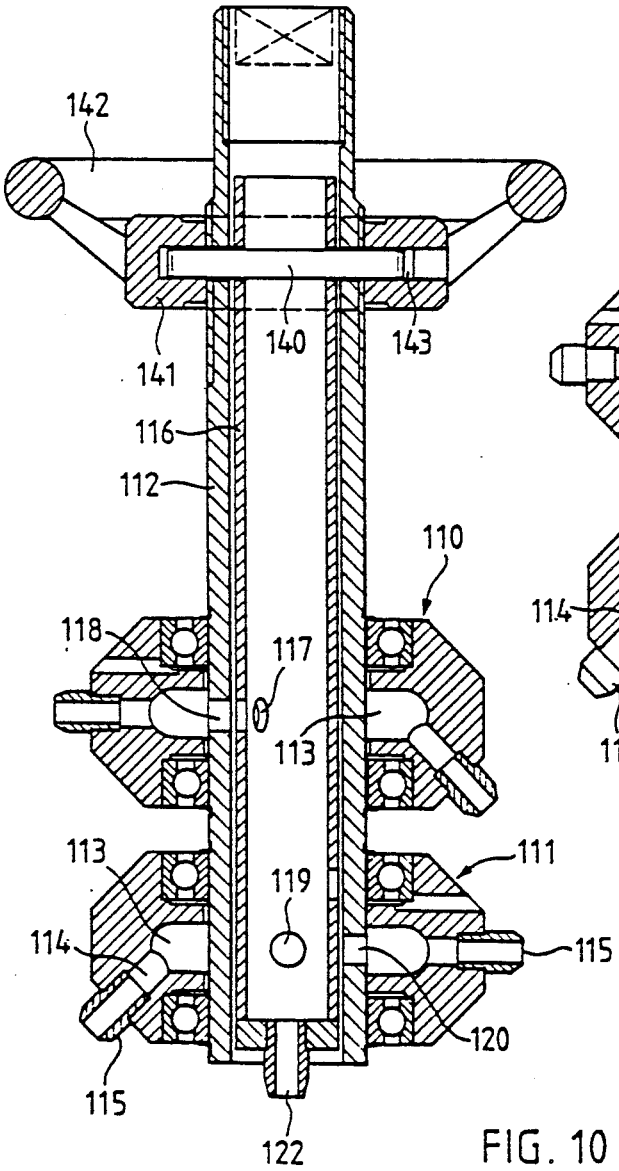
FIG. 10

PROCESS FOR RECOVERING CRUDE OIL OR REFINERY PRODUCTS FROM SLUDGY, THICKENED OR SEDIMENTED PRODUCTS

This application is a Continuation-in-Part application of U.S. Pat. application Ser. No. 6/800,604, filed as PCT/EP85/00090, Mar. 8, 1985, now abandoned.

The present invention relates to a method and apparatus to recover oil in slude or the like in an oil storage tank.

BACKGROUND

It is conventional practice in the recovery of crude oil, following possible degasification of oil extracted from the ground, to initially store the oil without further treatment in storage tanks, and keep it there ready for distribution. The tanks may hold 100,000m$^3$ fluid. The oil may be left sufficiently long in the tanks for considerable sediment to form, particularly under extreme climatic conditions. Crude oil as a natural product may have widely varying composition. The frequency of this sedimentation, the formation and nature of the sediments differ widely. In case of a conventional circular cylindrical crude oil tank with a diameter of approximately 100 meters, typical in the oil extraction industry, sedimentation layers of even a few dozen centimeters represent a loss of crude oil and, further, a substantial disposal problem. Sediment layers with a thickness of 1 to 1.5 meters, for example, are not infrequently encountered, particularly if, after various removal cycles, crude oil is constantly introduced without completely emptying the tank or without considering possible prior sedimentation.

The nature of the sedimentation depends on the type of crude oil. The sediment can be constituted by deposited asphalts or paraffins, waxes or other highly molecular weight hydrocarbons. The sediment may, however, also consist soley of thickened crude oil fractions. Crude oil thickens under various influences, for example under heat. This is a specific problem in desert areas. The oil sludge which forms may be of yogurt-like consistency. It can be considered as a crude oil fraction and largely consists of crude oil or thickened fractions which are re-dissolvable into crude oil.

This oil in sludge form is an undesired material. It reduces the tank capacity and clogs pumps. The material must be removed from the tank which, for example, involves cleaning the tank after it has been pumped empty.

It has been proposed to force compressed oil into the sludge to disintegrate the sludge by the force of the spurted compressed oil. U.S. Pat. No. 3,436,263, Strenkert et al, describes a process in which a cleaning material with which the oil residues are dissolved or removed in combination therewith is introduced. The final disposal of the sediment generally involves placing the oil sludge in a tank which is sacrificed for this purpose. Reprocessing of the oil sludge is not systematically considered or carried out.

French Patent 2,211,546 discusses dissolving sediments with foreign chemical substances. This may become a problem for the refinery operator since oil refineries are generally set up specifically for the treatment of crude oil. The equipment for such treatment operates with parameters adjusted in accordance with the source of the product to be processed. Foreign substances, such as dissolving chemicals which are introduced, may impede refinery operations. Refinery operators usually refuse to accept oil which is contaminated with such solvents.

Sludge which has been removed by chemical dissolution thus must be disposed, which is undesirable from an environmental standpoint; otherwise, a constant reduction of total storage capacity of the tank must be accepted.

THE INVENTION

It is an object to provide a process and apparatus in which crude oil contained in sludge or sediment can be recovered and which avoids any environmentally unacceptable disposal, without using any foreign substances which contaminate the crude oil.

Briefly, crude oil is pumped from a storage tank from a level at which the oil is still liquid. It is removed from this level by suction and introduced under pressure as a stream of oil into the crude oil above the sludge, by an injection lance, which converts the pressure into hydrodynamic energy, the injection lance being so constructed that the hydrodynamic energy inherent in the pressurized stream is distributed so that the sludge will become fluid and flowable. The result will be a mixture of fluidized crude oil sludge or sediment as well as the re-introduced crude oil or oil fraction which was in the tank to begin with, and at the upper layer thereof where it is readily flowable. The resulting mixture formed by the thus obtained flowable sludge and sediment, together with the introduced crude oil, can then be readily removed by pumping, as well known.

In accordance with a feature of the invention, a pumping unit, preferably a unitized aggregate, is provided which includes a withdrawal or inlet or suction tube, which can be inserted from the top of the tank into the region of the tank where readily flowable crude oil is present; placing the pumping aggregate at the top of the tank has the advantage that the energy needed to pump the readily flowable oil upwardly, and then compress it for re-introduction and injection into an injection lance which is located substantially below, reduces the overall energy requirements. The mechanical equipment is preferably placed on the top surface of a floating roof, which is customary in oil storage tanks. Relocating the equipment to the floating roof, especially the pumps and the motor drive therefor, permits elimination of the pressure loss previously incurred by having to pump up from the ground to the top of the tank wall and then back through the top of the floating roof into the interior of the storage area.

The system additionally permits the use of multiple small pump - motor aggregate units, rather than large capacity ground based pumps. The pump aggregates, together with the suction tubes and injection lances, can be moved around, since they can be small enough to be portable or movable on dolleys or the like. The motors, if electrical motors, are preferably of the explosion-proof type; otherwise, compressed air or hydraulic motors can be used.

The invention is based on the discovery that the sediment residues in a crude oil storage tank large consist of congealed crude oil. These residues can be re-liquefied by the very same material from which they congealed. Generally, crude oil in a tank will separate in various layers, the layer which is most fluid remaining on top. Crude oil, thus, can be introduces as the very same liquefaction agent of which the sediment or sludge is formed. The hydrodynamic energy of the injected crude oil destroys the essentially gel-like structure of the sediment. The affinity of the character of the injected material and the residue, that is, the sludge, make it possible to dissolve the crude oil together with the soluble particles.

The process has the advantage that the very same oil which is stored in the tank can be used for breaking up the sludge. This, unexpectedly, is possible without any additives of a chemical nature or of foreign types of oils used in cleaning operations or of water.

The system has the additional important advantage of high safety for operating personnel. No human intervention is needed during liquefaction and consequent discharge of the sludge or sediment which has been liquefied. There is no contact of the oil with any operating personnel. Break-up of sediment by workers using hand tools is completely eliminated. The process ensures maximum safety against fires and explosion.

The process can be carried out at any temperature; in petroleum-producing areas with various climatic conditions; it can be carried out without external heating, for example in arctic areas, or cooling, for example in desert areas. Likewise, it can be used under widely and frequently fluctuating temperature conditions.

Liquefaction of sludge can be carried out in tanks which are full or even partially full and, in the case of being partially full, during actual filling of the tank with fresh crude oil and/or during removal of oil and/or liquefied sludge therefrom. The transfer operation and the break-up of the sludge into flowable oil is not affected by other operating conditions pertaining to the tank.

In some installations, where no sedimentation as yet has taken place but is expected, the process can be used at random in crude oil tanks for the prophylactic prevention of thickening or sedimentation, by recycling comparatively fluid oil into the lower regions of a tank, where sedimentation might form, to thereby stir the lower portions and prevent sedimentation from originally occurring.

The injection lances preferably use nozzles with tips which are rotary. Crude oil, taken from the top of the tank, is then re-introduced under pressure through the rotary tips. The liquefaction lances can be introduced through existing openings in transportation or storage tanks. Preferably, a plurality of injection lances are used, placed to provide for interactive flow conditions within the tank. The pumps or pump-motor aggregates are located above the floating roof. This provides for optimum flow at lowest pumping energy requirements. The liquefaction lances can be controlled manually or remotely, and optionally with the aid of computers which may respond to characteristic parameters of the oil, such as freedom from contaminant particles which have been filtered, viscosity, or other conditions which can be tested and test results transferred to a program control unit or computer.

DRAWINGS

Details of the present process and the apparatus for performing the same will be described hereinafter relative to embodiments and the attached drawings, wherein:

FIG. 10 shows a second embodiment of a rotary nozzle for the apparatus for performing the process according to the invention; and FIG. 11 shows a third embodiment of a rotary nozzle for performing the process according to the invention.

DETAILED DESCRIPTION

Figure 1:
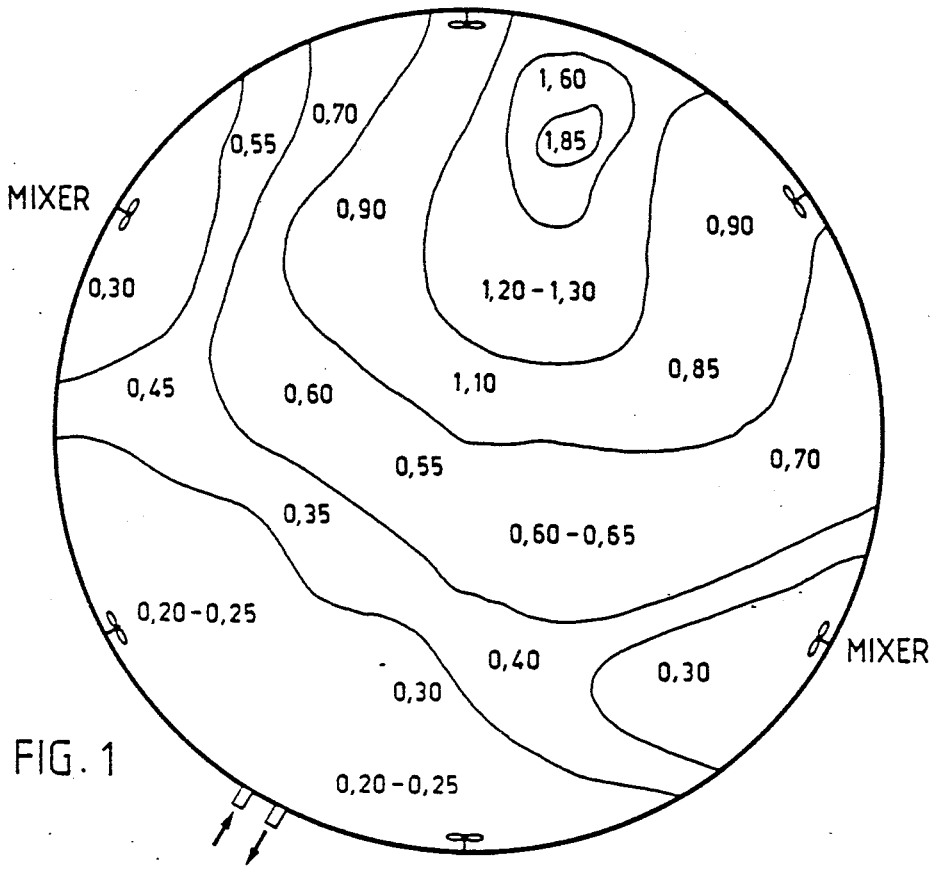
FIG. 1 shows a horizontally sectioned storage tank with a diameter of approximately 100 m, with a view of the topography of the sediments therein,.in diagrammatic form.
Figure 1A:
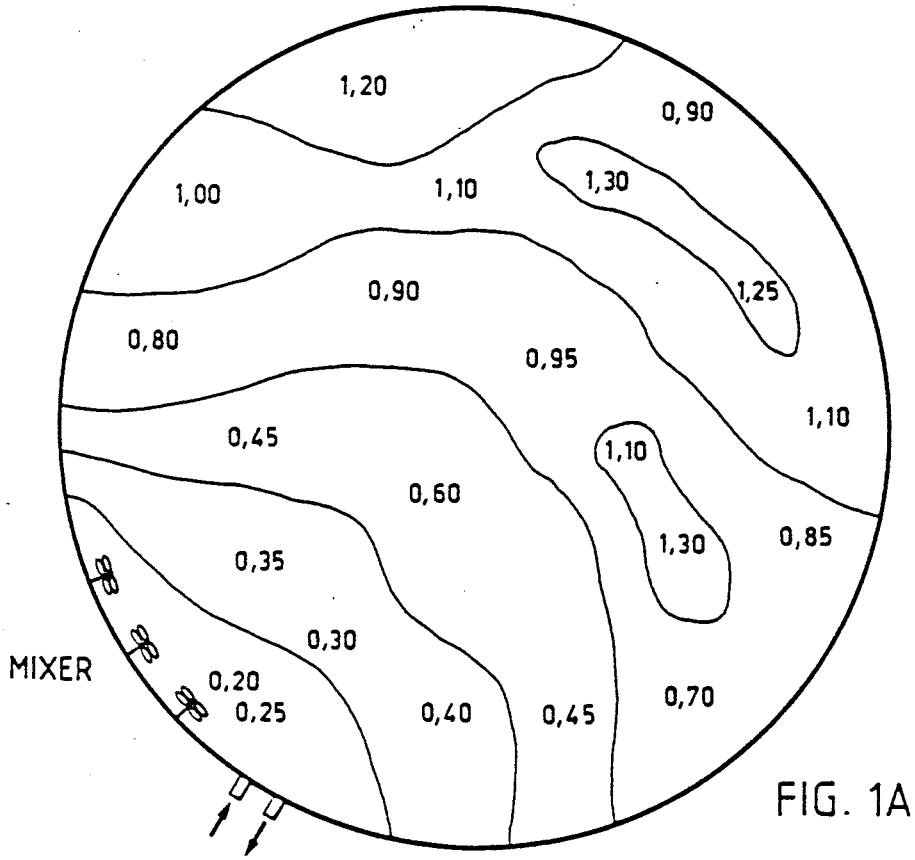
FIG. 1A shows another sediment relief in a storage tank with a diameter of approximately 85 m.

FIGS. 1 and 1A show examples of sediment reliefs of the type extending over the bottom of a storage tank with a diameter of approximately 100 m and a further storage tank with a diameter of approximately 85 m. In this example, measurement was carried out by means of piercing probes at various measurement points with the sediment height indicated in meters. It is pointed out that other known measuring means can be used, provided they satisfy the high demands made on explosion and fire protection. Mixing propellers are shown on the inner tank periphery and serve to maintain the tank content under slight movement and possibly prevent sedimentation. These mixing propellers influence the sediment topography, as a function of their position in the tank. The two examples are intended to show how the sediments are locally formed when the mixing propellers are uniformly distributed around the tank circumference (FIG. 1), or when they are solely located at one point (FIG. 1A). Generally, such measures only partly fulfill their function. The mixing propellers probably only lead to the formation of the sediment topography rising towards one side of the tank wall or towards the center of the tank, as in the case of the illustrated actually measured sediment collection formations. As indicated, it is an object of the invention to change such a sediment formation into the liquid phase and to separate foreign solid particles from this phase so as to be able to recover the crude oil combined by storage and sedimentation.

Figure 6:
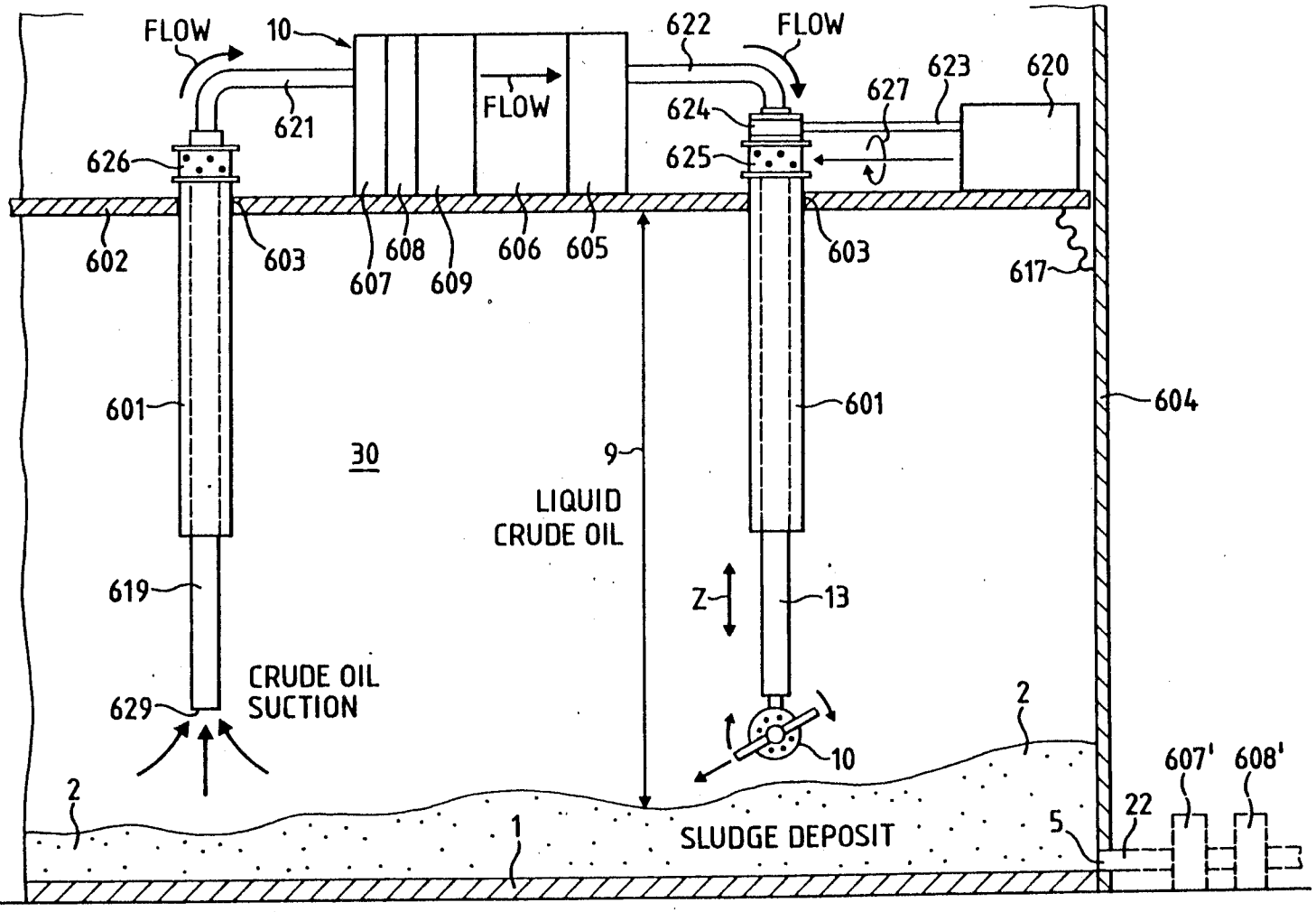
FIG. 6 is a highly schematic cross sectional view through a tank containing oil and sludge, and illustrating the system for re-liquefaction of sludge.

The tanks containing the sediments with the crude oil which it is intended to recovered, are generally vertically positioned, cylindrical tanks with approximately flat bottoms. As schematically shown in FIG. 6, they are covered by floating roofs 602 having on their underside stilt-like tubular legs 60 or supports replaceably attached to the roof, which can be normally inserted and removed through corresponding openings in the roof. The legs prevent the resting of the very heavy roof 602 on the ground or on the sediments, when the tank is emptied. In the case of wholly or partly filled tanks, the roof floats on the stored crude oil. However, the novel process can also be used for the recovery of crude oil from sediments, which have been deposited in tanks with firm roofs. The measured topographies of the sediments deposited on the container bottoms and shown in FIGS. 1 and 1A represent examples which will be discussed hereinafter.

Arrangement of the apparatus for injection and removal by suction.

A plurality of nozzles for injecting crude oil or fractions thereof are fitted in the sealed tank part, e.g. in openings 603 of floating roof 602. Use can be made of existing openings in the roof and possibly in the tank wall, particularly in the case of firm roofs and the nozzles are fitted into these. Compressed air or hydraulic oil-operated units or explosion-proof electrical motors provide for fire and/or explosion protection. Rotary nozzles are preferably used, driven by pressurized crude oil or fractions thereof used for dissolving the sediment as will appear.

The suspended sediment can then be removed by suction, for which purpose use is made of the existing tank drainage pipes and/or drainage pipes connected to openings on the pumps provided for this purpose, in much the same way as when fitting the nozzles.

High efficiency is achieved when using rotary nozzles and surface-covering rotary nozzle arms, with which the liquid jet can be directed horizontally, obliquely, vertically and in a combination of these directions. Thus, the action of a hydrodynamic energy can also be brought to bear behind flow obstacles, such as e.g. the supports of the roof. In addition, rotary nozzles make it possible to sum and direct the hydrodynamic energy in a planned manner or pattern by means of eddy formation and the resulting superimposed flows. Individual rotary nozzles can be looked upon as flow generator. The rotary nozzle continuously subject to the action of the hydraulic oil is the energy source of the eddy or vortex which, in a type of remote action, formed by the flow, tranforms pressure to hydrodynamic energy and simultaneously transfers liquefier material to the sediment topography. As will shown hereinafter, such flow generators can be combined into higher flow systems.

Figure 2:
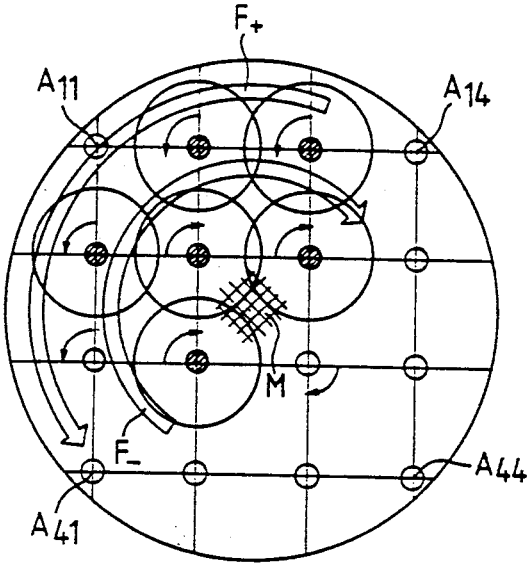
FIG. 2 shows a nozzle arrangement on a storage tank for supplying hydrodynamic energy and liquefiers to one area of the sediment topography.
Figure 3:
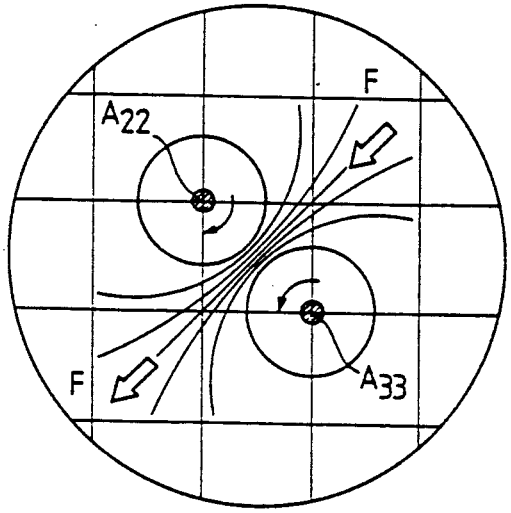
FIG. 3 shows the hydrodynamic action of the two nozzles rotating in different directions.

An optimized operating process is based on this idea of a controlled fluid eddy system, as is shown by the example of two oppositely directed eddies in FIG. 3. A22 indicates the center of a clockwise rotating eddy and A33 the center of a counterclockwise rotating eddy. The eddy is initiated by a rotary nozzle, which maintains the energy thereof. In the eddy system, a flow F forms from the top right to the bottom left and between the eddies the flow lines become concentrated and the flow rate is highest there. FIG. 2 shows a freely selected eddy system, e.g. placed on a grid with the coordinates A11 to A44. Part of the intersections are occupied with counterclockwise rotating and part with clockwise rotating nozzles. Nozzles A12, A13, A21, A31, etc., i.e. the peripheral nozzles rotate counterclockwise and primarily produce the counterclockwise flowing flow F+. Nozzles A22, A23, A32, A33 primarily produce the counterclockwise flow F−, which is supported by the peripheral nozzles. In the center, the conditions are unoriented and unclear from the flow standpoint and this is covered by the following operation of the nozzles according to FIG. 3. Both figures merely show the operating principle in part representation for clarity.

For static reasons, the stilt-like supports 601 on the tank roof are also systematically placed on a grid and generally pass in displaceable manner through the roof 602. If the roof is in the floating state, then a random number of supports can be drawn out and through the support openings it is possible to insert the liquefaction lcances with the rotary nozzles. In this case, there is no need to render inert the inside of the tank because there is no gaseous oxygen to produce an explosive gaseous mixture. It is always possible to produce a simple eddy system according to FIG. 3, but it is generally possible to produce a higher order eddy system, as is partly shown in FIG. 2, whilst producing powerful flow F− containing a large amount of hydrodynamic energy. The respective layer thicknesses of the sediment are measured to determine the sediment topography. A controlled eddy system and its hydrodynamic energy using the crude oil (or fractions thereof) in the tank can be used in planned manner for liquefying the sediment. In the case of sediments according to FIGS. 1 or 1A, e.g. when using only two nozzles according to FIG. 3, the thicker layers and in part almost up to 2 meters thick (FIG. 1), can be broken down to such an extent that they assume an average thickness. Flows according to FIG. 2 can then be produced.

There is no need to place the nozzles at the selected coordinates before each operating cycle. In fact, it is much more appropriate to adopt a "flow action plan" and place a plurality of rotary nozzles in an optimum manner and then control them as regards the height and rotation direction with respect to one another. The operating, i.e. rotating nozzles are preferably lowered through a crude oil layer above the sediment on or into the latter and then the flow formed is controlled vertically. The boundary between oil and sludge is diffuse and the division line shown in the drawings should be considered approximate only and, actually, is in form of a wide band. The rotation direction of nozzle pairs can be altered in operation for reversing the flow direction and such a nozzle arrangement is described relative to FIGS. 10 and 11. The nozzles are advantageously controlled by means of a computer by means of the basic flow action plan, considering parameters, such as use times, height position, rotation direction and interdependent pairs of rotary nozzles.

Figure 4:
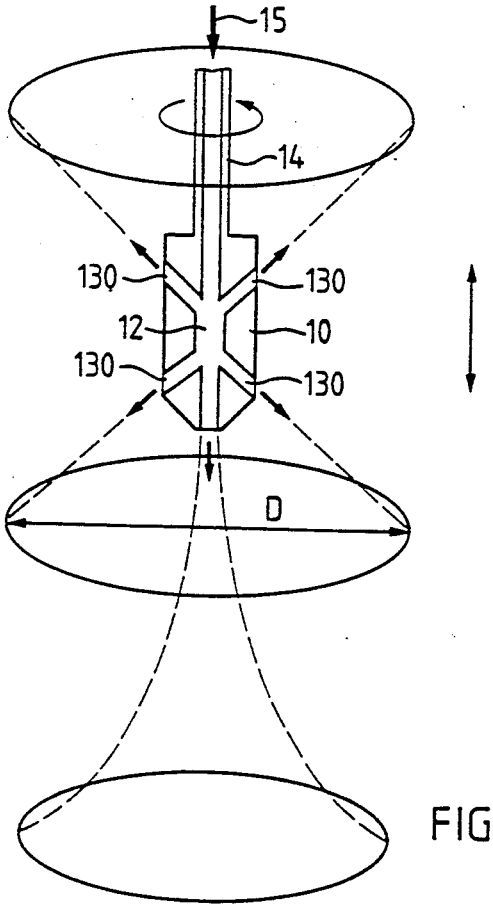
FIG. 4 shows the approximate spatial spread of an undisturbed liquid jet from a rotary nozzle tip of the apparatus according to the invention.
Figure 9:
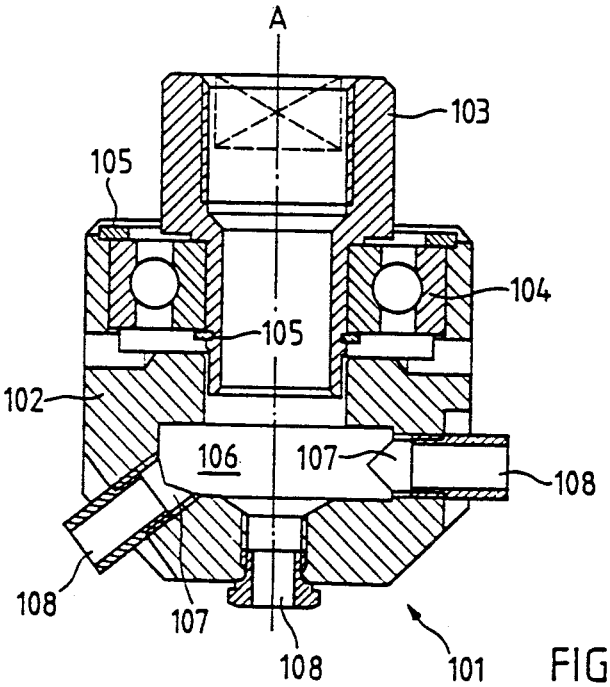
FIG. 9 shows a first embodiment of a rotary nozzle for an apparatus for performing the process according to the invention.

FIG. 4 diagrammatically shows an embodiment of a rotary nozzle with its approximate spatial action range, further details being given in FIGS. 9, 10 and 11. For safety reasons, the rotary nozzle tips are oil-driven. Compressed gas operation is also possible. Preferably, the drive is provided by the actual liquefying agent and the crude oil to be injected and used in this case is pressurized and passed through by feed pumps 605 (FIG. 6). Through openings 130, nozzle tip 12 sprays crude oil in three directions. The idealized generated surfaces of an undisturbed rotating liquid jet are indicated around the nozzle tip. A diameter D of up to 10 m is possible. However, in the case of operation only the macroscopic effects of the nozzle body immersed in the crude oil are effective. This is a gradually forming wobbly eddy, as described hereinbefore. In the example shown, the crude oil is passed axially downwardly while rotating in the same direction. Under best conditions, a nozzle cone is formed, which undergoes a generally trumpet-shaped widening impact with the tank bottom. The other two cones, in which the liquid is passed obliquely upwardly and obliquely downwardly, are conical generated surfaces describing the rotary liquid jet and not nozzles cones.

Figure 5:
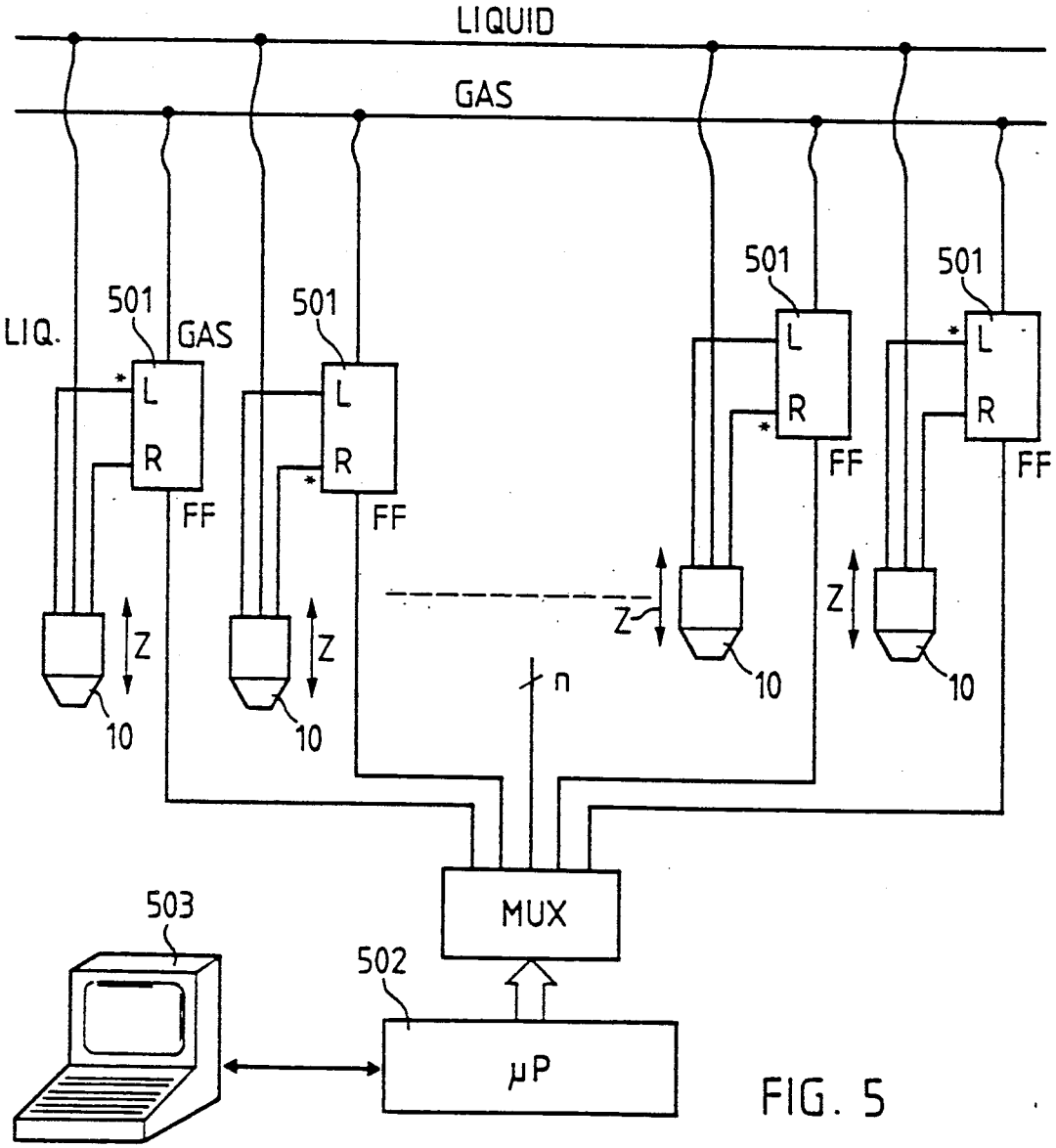
FIG. 5 is a circuit diagram of a plurality of individual liquefaction lances with nozzles, which produce individual eddies or vortices cooperating to give an eddy or vortex system.

Nozzle tip 10 (FIG. 4) comprises an inner body containing liquid chambers and ducts, which are connected to the crude oil supply 15, together with a rotary cap 14 having a plurality of nozzle openings (FIG. 4). The cap can be driven by a compressed air or compressed oil turbine, which can be designed either for clockwise or counterclockwise operation; or the nozzle tip is equipped with clockwise or counterclockwise rotating turbines. In such a larger system, the compressed fluid valves are preferably computer-controlled. Such controls, together with the software, have by now been developed to perfection for general uses. FIG. 5 shows such a control. If hydraulic oil is used as the fluid for the rotation of the nozzle, it can be the oil to be injected under pressure and it is then recommended to use a nozzle tip, as described hereinafter relative to FIGS. 9, 10 and 11.

LIQUEFACTION OF THE SEDIMENT

According to a feature of the invention, hydrodynamic energy is utilized for liquefaction, by injecting a crude oil jet under pressure into the oil just above the solid phase (see FIGS. 6 and 7) or, for prophylactic use, in the bottom region of the tank. The sediments frequently have a thixotropic behavior. Liquefaction rapidly occurs when the sediments become flowable. Using crude oil from the same source as that which caused the sludge, and transferring energy into the solid phase, has several advantages:

The risk of introducing impurities into the crude oil is effectively eliminated;

complete affinity between the transfer or liquefying agent is obtained; as a result of this affinity, the solid phase is re-absorbed to the maximum extent in the liquid supplied thereto;

smaller quantities of fresh crude oil or fractions thereof-can be used for re-liquefication, thus reducing pumping energy requirements;

the liquid phase pumped out by drainage can be constantly tested for vicscosity and returned into the nozzle lines for liquefaction when the viscosity reaches a given threshold;

a filter can be introduced into the recirculation line for removing impurities which are extraneous to the oil itself, such as sand, rust from the tank or connecting lines or the like.

The re-liquefied residue, together with the crude oil or fraction used for liquefaction can then be passed into a further storage tank, or directly to the refinery to permit its normal further use as crude oil.

This apparatus essentially comprises pressure medium-operated liquefaction lances 13 (FIG. 6). The are rigid oil supply pipes with fitted nozzles, or multisection pipes provided with hollow joints as well as a pump unit 610 for the supply of fresh liquefier, such as crude oil or fractions thereof, used for liquefaction. The pump unit 610 maintains the recirculation of the liquefied phase back to the nozzles; it, of course, may be used optionally for removing the liquefied phase to another tank, where it is used as normal crude oil, or back to the refinery for further processing.

Figure 7:
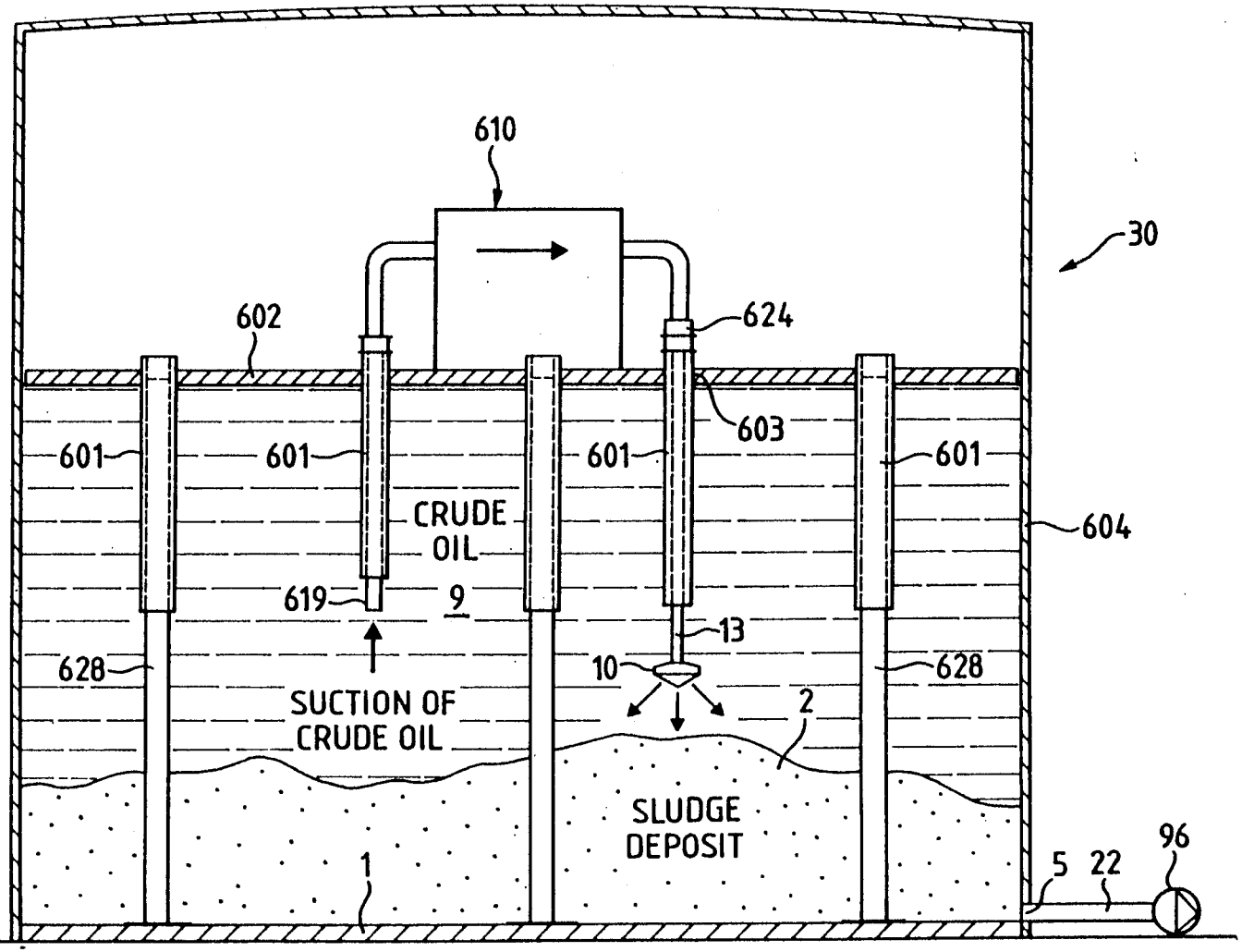
FIG. 7 illustrates a tank with the system, to a reduced scale, and showing the overall arrangement.

Referring to FIGS. 6 and 7:

Filters 607 are preferably used in the recirculation lines 621, 622 to permit the removal of solid impurities. The necessary pipelines may be provided with branches and valves or taps (not shown) so as to divert the liquid flow when required. Advantageously, flow meters are used to enable yields to be checked. A test station 608 typically contains instruments for measuring viscosity, the oxygen content, or carrying out other analyses as well known.

FIG. 6 diagrammatically shows an embodiment of an apparatus for performing the process according to the invention in a partly emptied crude oil storage tank 30, with a floating roof 602, having hollow stilt-like supports 601. The proportions in the drawing have been set at random to facilitate easier representation. The roof is sealed all around with sealing material 617, which adheres to the tank wall 604 and roof 602 by suitable attaching material. As a result, a sliding gap is sealed with respect to the outside as well known. This seal is not always essential, but desirable for safety. The sludge layer 2 is now sealed from the outside, and is indicated as an irregular collection of residue. FIGS. 1 and 1A show examples of measured sediment layer topographies, as occur in large storage tanks. The tank bottom 1 (FIG. 7) slopes towards a suitable tank outlet 5, to which is connected a removal pipe 22 for removing the suspended sediment. Filters 607' and test instruments 608° can be inserted in line 22, if desired.

One or more liquefaction lance or lances 13 with rotary nozzle 12 (FIG. 4) is/are lowered through working openings 603, which have been left open, into the liquid area 9 of the tank 30. These nozzles inject fresh crude oil or, if necessary, fractions thereof, or recirculated oil under an adapted pressure of e.g. 5 to 30 bar into the sediment. Apart from their rotation, the nozzles can be moved in the direction of arrow Z (FIG. 6) enabling a specific radius to be covered. The individual lances 13 can be combined to a main pressure manifold , which can be connected to a multiway valve. The present apparatus permits the necessary circulation and the formation of a vigorous flow between the nozzles, as shown in FIG. 3.

The pump is preferably a combined aggregate including an electric motor drive of the explosion proof type, for example of the type API 610, which is coupled to a pump having a suction portion 609 and a pressure portion 605. An air compressor 620 is preferably part of the unit. The filter 607, test unit 608, suction pumps or portions 609, pressure pump or portion 605, and motor 606 form a subaggregate unit 610 which can be combined with the air supply generator 620. Air supply or compressor 620, which may be electrically operated directly from the pump motor, or having its own motor, provides compressed air through line 623 to the injection lance 13. The compressed air is used to rotate the nozzle 10.

The inlet to the aggregate or unit 610 is a suction tube or pipe 619, which may include a perforated outer surface and formed with a bottom inlet 629. The unit is preferably so dimensioned that it can be fitted directly on top of the leg sleeve 601, to extend therethrough. Such leg sleeves are provided customarily, to fit about projecting posts 628 (FIG. 7) to provide for guidance throughout the circumference of the tank for the movable or floating roof 602. The inlet suction pipe 619 is introduced through such leg sleeves in positions where there are no posts or roof legs 628. Similarly, the injection lance 13 is passed through a leg sleeve 601 in a position where there is no post 628.

Flow from the inlet line 619 is through a flexible hose 621 and then through filter 607, through a test unit 608 if desired to the suction pump or portion 609. If desired, a separate pump can be used with powerful suction and discharge at low discharge pressure, to be coupled to a positive pressure pump 605, which applies its output through a high-pressure hose 622 to the injection lance 13. Preferably, a rotary coupling 624 is interposed between hose 622 and the inlet to the lance 13. Terminal fixtures or couplings 625, 626 connect the respective inlet 619 to the hose 621, and hose 622 to the lance 13.

Depending on the size of the unit 610, one or more inlet pipes 619 may be coupled thereto; also, one or more injection lances 13 may be coupled to the outlet. If necessary, suitable connecting manifolds are used, as well known in fluid collection and distribution.

It is possible to give controlled working cycles to the pumps and the nozzles, under control of a computer, which in turn exploits program-bound test results from the system for the process. Such results are obtained from the measuring instruments such as e.g. a viscosimeter in test unit 608, 608'. Other measured points and parameters are conceivable, which supply the process with data used for controlling, regulating and checking purposes. In order e.g. to protect such measuring instruments measuring the flow and the nozzles and to remove extraneous particles from the suspended solution, filters 607, 607' are preferably provided in the system.

For yield checking purposes, flow meters can be arranged at suitable points.

FIG. 5 diagrammatically shows a plurality of individual nozzles combined to form a controlled eddy or vortex system. Each rotary, raisable and lowerable nozzle tip 10 is diagrammatically indicated with three inlets, one for the crude oil to be injected, one for the compressed fluid, e.g. compressed air or hydraulic oil for counterclockwise movement and one for compressed air or hydraulic oil for clockwise movement. The compressed air or hydraulic oil is introduced by means of an L/R distributor 501 (L/R=left/right). A common liquid pressure pipe supplies all the nozzles and a common fluid pressure pipe supplies all the L/R distributors 501. The L/R distributors 501 are switchable fluid, i.e. pneumatic or hydraulic units, whose control lines are connected to a multiplex circuit MUX. The multiplexer MUX is computer-controlled by microprocessor 502 and is able to simultaneously switch several addressed outputs. FIG. 5 shows in each case one eddy or vortex pair at different levels Z. The outputs activated on the L/R distributor 501 are indicated by an asterisk. An n-line connected to the MUX is intended to show that the number of nozzles to be operated is freely selectable. A combined display/input/output unit 503 is coupled to computer 502.

Figure 8:
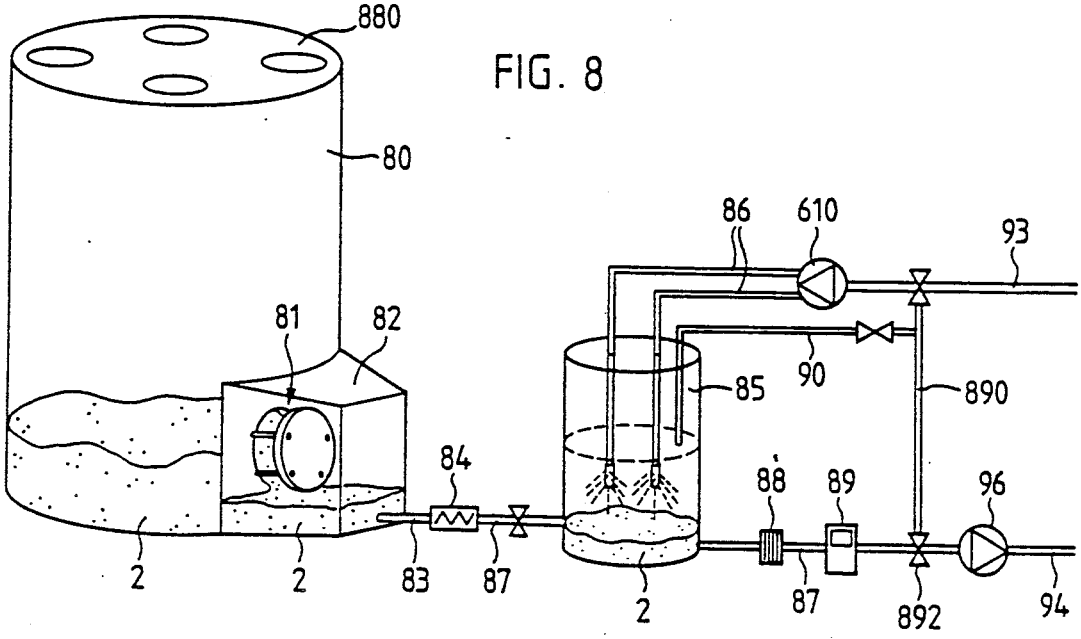
FIG. 8 is a diagram showing a further embodiment of the method and system with an auxiliary tank.

FIG. 8 shows an apparatus of the type which can be used with storage containers or tanks having a firm roof. Such a storage container or tank 80 generally has a plurality of maintenance hole entrances 81 distributed around its circumference as well as on the roof 880. One of the side entrances 81 is shown in the drawing. It can occur that as a result of the thickness of the sediment, i.e. the height of the sediment, an opening 81 becomes completely covered preventing the planned opening of the seal or closure. A reservoir 82 is attached to such a maintenance hole 81. It will fill with oil sludge after successive, partial opening operations of the maintenance hole cover. A feed pipe 83 with a screw conveyor 84 is connected to reservoir 82 to feed the oil slude soaking into the reservoir 82 into a preferably mobile auxiliary liquefaction tank 85, which is here shown only schematically and into which the liquefaction system and the lances can then be introduced. The liquefied oil sludge mixed with the supply crude oil or fractions thereof is led away by means of a pipe 87 According to the description relative to FIG. 6 or 7, recirculation can take place by means of the line system 86, together with filtering by means of a filter 88, viscosity measurement with an instrument 89. Measurements are taken in the removal line system 87. The recirculation pipe seen at 890. The three-way valves 891, 892 and pump unit 96 as well as a fresh oil supply 93 may be used. Removal e.g. for storage or to the refinery is through line 94. What has been stated in conjunction with the apparatus according to FIGS. 6 and 7 generally applies in connection with the embodiment of FIG. 8.

A more detailed description will now be given of a liquefaction lance. One or a plurality of such lances combined into a vortex or eddy system essentially constitute the instrument by means of which the crude oil or fractions thereof as the liquefier and as the kinetic energy carrier is introduced into a tank, so that oil sludge sediment liquefaction can taken place. Each lance essentially comprises a pipe system and a nozzle. The pipe system connects the vertically adjustable nozzle to a supply line by means of which the nozzle is supplied with the pressurized crude oil or fractions thereof. In the preferred embodiment, the nozzle is used for injection said crude oil or fractions thereof into the sediment. Each lance nozzle tip can, according to FIG. 9, be provided with a single nozzle tip, or according to FIG. 10 with two alternately usable nozzle tips.

A rotary nozzle 101 according to FIG. 9 has a distribution head or manifold 102, which is mounted in rotary manner on a tubular connecting piece 103. In the case of the present embodiment, mounting takes place with the aid of ball bearings 10 but it is also possible to provide roller or sleeve bearings and the like. Two attachment elements 105, e.g. C-clips, axially hold together the two parts which can be rotated counter to one another. For example, by using a thread, the connecting piece 103 is fixed to the inlet end of the pipe system (not shown). The distribution head 102 has a central cavity 106, into which a plurality of bores 107 terminate, whose axes point in different directions in space. A sleeve 108 is placed in each bore 107, projects beyond the distribution head 102 and forms the actual nozzle opening. These sleeves which are subject to considerable wear can be detached in a simple manner, e.g. with the aid of a screw connection and are therefore interchangeable. It is important for the function of this nozzle for the axes of the bores 106 not to be directed radially or axially with respect to the distribution head 102. Instead, at least one bore axis has a tangential component for the rotary drive.

The crude oil or fractions thereof is fed by the pump into the liquefaction lance pipe system and passes through the tubular connection piece 103 into cavity 106 of distribution head 102 and from there passes out through bores 107 into the tank. As the bores are directed in such a way that the oil has at least one tangential velocity component, the nozzle is rotated by the reaction. Thus, as stated hereinbefore, the oil streams injected reach substantially all points of the tank, even those which are accessible only with difficulty due to tank components.

The nozzle tipes with two superimposed rotary nozzles 110, 111 shown in FIGS. 10 and 11 are secured in roughly the same way as in FIG. 9 to a connecting piece 112, which is axially longer and projects through the nozzle tip. The nozzle tips have in each case an annular cavity 113, into which issue discharge bores 114 with nozzle sleeves 115. These bores 114 are oriented in such a way that they are able to rotate the particular nozzle tips in different rotation directions when oil flows out. Within the connecting piece 112 and coaxially thereto is provided a control piston 116 which is vertically displaceable with respect to the connecting piece and which in this case has an axially directed discharge nozzle 122. This axially directed opening is rotationally unaffected and in this case helps to increase the total hydrodynamic energy.

In the case of the embodiment according to FIG. 10, the control piston 116 has one or more radial openings 117 level with the upper rotary nozzle 110 and on rotating the piston can be aligned with the corresponding openings 118 of the connecting piece. Openings 118 in turn issue into the annular cavity. On a level with the lower rotary nozzle 111, pipe 116 also has one or more openings 119, which can be aligned with corresponding openings 120 in the connecting piece. Pipe 116 can be rotated from a closed position into a first throughflow position, through openings 117 and 118 being aligned, or can be rotated into a second throughflow position as a result of openings 119 and 120 being aligned. As a function of one of the three pipe positions, one or another nozzle tip is supplied with hydraulic oil, so that the same liquefaction lance can produce oil eddies with different rotation directions. In this case, pipe 116 is closed at the bottom and is provided with a downwardly directed nozzle opening 122.

The arrangement according to FIG. 11 shows another embodiment for the control of the rotation direction. Instead of the control piston 130 being rotatable about its axis, it is in this case vertically displaceable and only has oil passage openings 131 at one level. The connecting piece has in turn aligned openings 132 level with the upper rotary nozzles and opening 133 level with the lower rotary nozzles. In this case, control piston 130 is closed at the bottom. It can be vertically displaced in such a way that it either assumes its closed position in which its openings 131 are covered by connecting pice 112 so that no oil can flow out, or it assumes a first throughflow position in which openings 131 and 132 are aligned, or it assumes a second throughflow position in which openings 131, 133 are aligned. In the last two positions, in each case one of the rotary nozzles is supplied with oil, so that the liquefaction lance can produce eddies with different rotation directions. In the case of the last-described arrangement, control piston 130 and connecting pipe 112 are closed at the bottom, because the downwardly directed nozzle outlet is eliminated.

Known means can be used for adjusting the control piston. In the two embodiments according to FIGS. 10 and 11, a manually operable screw adjustment is provided. A sleeve 140 is fixed to the control piston 116 or 130 and fitted into an annular slot 143 of an adjustment wheel 141 with an annular adjustment grip 142. On rotating without axial displacement (FIG. 10), sleeve 140 and annular slot 143 are fixed together and the adjustment wheel 141 has no means for axial movement along connecting piece 112. In the case of an axial control displacement (FIG. 11), sleeve 140 runs freely in sliding slot 143. A spiral 145 is coupled to connecting piece 112, along which can run the adjustment wheel 141, drawing with it the control piston 130 fixed to sleeve 140 in axial direction.

Placing all the equipment on the top of the floating roof 602 has the advantage that pressure losses in pumping are a minimum; thus, pumping energy is reduced. In prior art structures, it was customary to place all pumping units outside of the tank. Relocating the equipment on the roof eliminates losses incurred by having to pump up from the ground over the top of the tank wall and then back down through the top of the floating roof into the interior of the storage area. Due to the high viscosity of the material being pumped, little energy is recovered upon downflow of the fluid back into the tank. The system permits use of multiple units 610, small explosion-proof motors and the like, which can be moved about on the floating roof, rather than bulky large-capacity ground based pumps.

The roof based system preferably utilizes groups of from between 8 to 12 sets of inlet pipes 629, coupled through a suitable manifold to a pump, and supplying between 8 to 12 sets of liquefaction lances 13.

Each set of such equipment, at least, uses one inlet pipe 629 and one lance. The inlet is preferably taken from a region somewhat below one meter from the surface of the crude in the tank. It is discharged under pressure to an injection lance 13 about 5 to 7 meters away from the inlet pipe, into a sludge deposit at a depth of between 2–3 meters above the surface of the sludge, up to the actual sludge surface. In the liquefaction area, the nozzle can spray and directly influence a region covering 180° by rotation and oscillation elements, or ducts of the nozzles themselves, and fitted at the head of the lance 13, powered, for example, by compressed air forming part of the unit 610. Alternatively, the nozzle can be coupled to be driven by a compressed air motor at the top of the floating roof, or by an electric motor, so that the entire lance and the nozzle set rotates, driven from a top-mounted rotation drive. The rotary coupling 624 provides for oil supply of the recycled crude while permitting rotation of the liquefaction lance from the top.

Rotary drive of lance 13 from the top is schematically indicated by rotation arrow 627 (FIG. 6).

The system has the advantage that the equipment can be easily transported since size and weight of the unit 610 can be substantially reduced with respect to prior art structures. It has been found by actual experience that placement of suction inlets 619, and a set of injection lances 13, together with relocation of the equipment 610, can be carried out in about 1 to 2 hours. This permits keeping the storage tank in operational readiness at all times, that is, ready to receive or discharge crude oil as may be required, without danger of sedimentation. Locating and relocating injection lances which have to be coupled to remotely placed ground based equipment is substantially more cumbersome and time consuming.

Providing a combined unit 610, which includes the necessary suction and pressurization apparatus, as well as a power drive 627 —if required—to the injection lances, has the additional advantage of being environmentally safe, that is, it eliminates occupational health and safety hazards. Buckling or breaking of the floating roof itself is effectively avoided since the weight of the equipment is so low that it can be easily carried by the customary floating roof structures in tanks. Very importantly, pressure losses which occur with remotely located systems are eliminated since there is no need to pump up vertically from the ground and then force the heavy crude downwardly, with only minimum assistance of gravity for its flow through a pipe.

Various changes and modifications may be made and features described in connection with any one of the embodiments may be used with any of the others. Specifically, the location and relocation of the various accessory elements, such as the filters 607, 607' (FIG. 6), 88 (FIG. 8), test equipment 608, 608', 89, and the selection of automatic control (FIG. 5) or manual control (FIG. 11) can be adapted and varied as desired.

We claim:

1. A process for recovering crude oil from crude oil residues in a storage or transportation tank containing said crude oil and said residues, wherein said tank retains crude oil in fluid state and wherein said residues essentially comprise a sediment of thixotropic thickened sludge and sedimented crude oil or refinery products obtained from said crude oil below said crude oil in fluid state and essentially at the bottom of the tank, said recovery method comprising the step of introducing, under pressure, a plurality of streams of pumped oil above said residues, said introducing step including converting said pressure into hydrodynamic energy and distributing said hydrodynamic energy inherent in said pressure streams to a layer of said crude oil in the tank above said residues by shaping said streams to form eddies which rotate in different directions so that said energy will render said thixotropic residues into a pumpable flowable condition and to thus obtain a mixture of fluidized crude oil sludge and sedimented crude oil with said introduced crude oil; and removing the resulting mixture formed by the thus obtained fluidized sludge and sediment with the introduced crude oil.

2. The process of claim 1, including the step of pumping crude oil from said tank by suction from an upper portion of the crude oil in the tank;

and reintroducing, under pressure, said stream of pumped crude oil just above said residues.

3. The process of claim 1, wherein said step of converting said pressure into hydrodynamic energy by shaping said streams to form eddies which rotate in different directions comprises shaping said streams by planned flow formation to form counter rotating fluid eddies, in which the hydrokinetic energy of said oil streams in the counter rotating eddies successively returns said residues to said flowable condition.

4. The process of claim 1, wherein said step of introducing a stream of flowable crude oil and converting the pressure thereof into hydrodynamic energy comprises introducing a plurality of adjacent streams in a manner to generate eddies, by introducing adjacent streams at locations so placed with respect to each other that the eddies of adjacent streams result in a sum flow to enhance the effect inherent in the pressurized streams to render said residues to a pumpable flowable condition.

5. The process of claim 1, wherein the step of introducing the stream of flowable crude oil under pressure comprises passing a pressurized stream of said flowable crude oil or crude oil fraction through a rotary nozzle to apply said stream to the layer of oil above said residue and convert said pressure into said hydrodynamic energy.

6. The process of claim 2, wherein said step of pumping crude oil from said tank comprises the step of pumping crude oil b suction from a level below the upper level of said crude oil in the tank and in a region where said crude oil in the tank has, with respect to all of the crude oil in the tank, low viscosity.

7. The process of claim 6, including the step of checking the degree of viscosity of said resulting mixture, and continuing the pumping and reintroducing steps until the degree of viscosity reaches a given threshold level.

8. The process of claim 6, including the step of filtering the mixture after the removal step.

9. The process of claim 1, including the step of sealing the tank against ambient air while carrying out said steps of introducing, under pressure, the stream of flowable crude oil or crude oil fraction, converting said pressure into hydrodynamic energy, and removing the resulting mixture.

10. A process for recovering crude oil from crude oil residues located at the bottom of a storage or transportation container (80) comprising the step of transferring said residues from said storage or transportation container (80) into said storage or transportation (85) tank; and then carrying out the process for recovering the crude oil from the crude oil residues, as claimed in claim 1, in said storage or transportation tank (85).

11. The process of claim 10, wherein said transferring step comprises transferring said residues by continuous screw conveying of said residues from the storage or transportation tank (80) into the auxiliary tank (85).

12. The process of claim 1, wherein said step of converting said pressure into hydrodynamic energy comprises introducing, under pressure, a plurality of streams of said pumped crude oil above said residues, said streams including rotary flow of the oil of said streams above and close to said residues to form vorteces or eddies within said flowable crude oil, in which the direction of rotation of the respective vorteces is selected to generate circulation currents (FIGS. 3: F) within said crude oil, and sufficiently close to said thixotropic residues to render said residues pumpable and flowable.

* * * * *